US008662496B2

(12) United States Patent
Hsu et al.

(10) Patent No.: US 8,662,496 B2
(45) Date of Patent: Mar. 4, 2014

(54) MULTIFUNCTION PRINTER AND STOPPER APPLIED THEREIN

(75) Inventors: Kai-Chuan Hsu, New Taipei (TW); An-Hsiu Lee, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/420,592

(22) Filed: Mar. 14, 2012

(65) Prior Publication Data

US 2013/0154182 A1 Jun. 20, 2013

(30) Foreign Application Priority Data

Dec. 20, 2011 (TW) ..... 100147468 A

(51) Int. Cl.
*B65H 3/06* (2006.01)
*B65H 3/52* (2006.01)

(52) U.S. Cl.
USPC ..... 271/117; 271/121

(58) Field of Classification Search
USPC ..... 271/121, 117, 118
See application file for complete search history.

(56) References Cited

U.S. PATENT DOCUMENTS

| | | | | |
|---|---|---|---|---|
| 6,547,235 | B2 * | 4/2003 | Higaki | 271/10.01 |
| 7,255,339 | B2 * | 8/2007 | Hung et al. | 271/122 |
| 7,506,867 | B2 * | 3/2009 | Lee et al. | 271/117 |
| 7,753,363 | B2 * | 7/2010 | Liu et al. | 271/121 |
| 8,052,139 | B1 * | 11/2011 | Su et al. | 271/117 |
| 8,061,705 | B1 * | 11/2011 | Su et al. | 271/117 |

FOREIGN PATENT DOCUMENTS

| | | |
|---|---|---|
| TW | M290160 | 5/2006 |
| TW | 201024096 | 7/2010 |

* cited by examiner

*Primary Examiner* — Luis A Gonzalez
(74) *Attorney, Agent, or Firm* — Jianq Chyun IP Office

(57) ABSTRACT

A multifunction printer (MFP) and a stopper applied therein are provided. The MFP includes a body, a top cover and the stopper. The body has a paper conveyor path, a paper holder located in front of an entrance of the paper conveyor path and a first rotating axle located in the paper conveyor path. A first side of the top cover rotates about the first rotating axle to be close to the paper holder. The stopper has a second rotating axle connected to the body, a connecting portion and an eccentric portion. The connecting portion is connected between the second rotating axle and the eccentric portion. The eccentric portion hangs down at the entrance of the paper conveyor path. A center of gravity of the stopper is located in the eccentric portion. A first stopping point of the top cover is located in a rotating path of the eccentric portion.

3 Claims, 5 Drawing Sheets

MULTIFUNCTION PRINTER AND STOPPER APPLIED THEREIN

CROSS-REFERENCE TO RELATED APPLICATION

This application claims the priority benefit of Taiwan application serial no. 100147468, filed on Dec. 20, 2011. The entirety of the above-mentioned patent application is hereby incorporated by reference herein and made a part of this specification.

BACKGROUND OF THE INVENTION

1. Field of the Invention

The present invention relates to a stopper and a multifunction printer (MFP), and particularly to a stopper with a structure different from that of a conventional stopper and an MFP fitted with the stopper.

2. Description of Related Art

With the advent of the information society, an office may be provided with office automation equipment, for example, a scanner, a photocopier, or a printer, and a user may perform word processing operation by the aid of the office automation equipment. It should be noted that when being configured in the office at the same time, the office automation equipment occupies a lot of space. Therefore, an MFP integrated with, for example, photocopying, printing, and scanning functions is developed to solve the above problem.

Generally, the user puts a stack of paper in the MFP for photocopying, printing, or scanning. The MFP needs a stopper to precisely stop the paper before the paper is fed into the MFP, so as to avoid the influence on the printing procedure or printing quality caused by too much paper fed.

FIG. 1 is a schematic view of a conventional MFP. Referring to FIG. 1, a paper feeder of the conventional MFP includes a first stopper 110, a second stopper 120 and a convex rib 130 disposed in an inner casing and for driving the first stopper 110. In case that the paper is not fed, the first stopper 110 contacts the second stopper 120 to limit the second stopper 120, and the second stopper 120 prevents the entering of the paper. When the paper is fed, the inner casing descends and the convex rib 130 disposed in the inner casing pushes the first stopper 110, so that the first stopper 110 rotates clockwise and releases the limitation to the second stopper 120, and accordingly the second stopper 120 can freely rotate. In this case, through the rotation of a paper feed roller, the paper can freely pass through the second stopper 120 and enters a paper conveyor channel.

However, the ineffective operation of the first stopper 110 or the second stopper 120 may be caused due to the imprecise reposition of the first stopper 110 or the second stopper 120. In addition, two stoppers are required in such a design, so the material cost is high.

SUMMARY OF THE INVENTION

Accordingly, the present invention is directed to an MFP able to effectively continuously operate.

The present invention provides a stopper with a structure different from that of a conventional stopper.

The present invention provides an MFP, which includes a body, a top cover and a stopper. The body has a paper conveyor path, a paper holder and a first rotating axle, in which the paper holder is located in front of an entrance of the paper conveyor path, and the first rotating axle is located in the paper conveyor path. The top cover is disposed on the body, and a first side of the top cover is adapted to rotate about the first rotating axle so as to be close to the paper holder of the body, in which the top cover has a first stopping point. The stopper has a second rotating axle, a connecting portion and an eccentric portion. The second rotating axle is connected to the body, the connecting portion is connected between the second rotating axle and the eccentric portion, and the eccentric portion hangs down at the entrance of the paper conveyor path. A center of gravity of the stopper is located in the eccentric portion, and the first stopping point is located in a rotating path of the eccentric portion, so as to limit the rotation of the eccentric portion. When the first side of the top cover rotates about the first rotating axle so as to be close to the paper holder, the first stopping point releases the limitation to the eccentric portion, and the eccentric portion is adapted to rotate clockwise about the second rotating axle.

In an embodiment of the MFP of the present invention, the top cover further includes a second stopping point, and a first end of the eccentric portion that is kept relatively away from the entrance is located between the first stopping point and the second stopping point. When the first side of the top cover rotates about the first rotating axle so as to be close to the paper holder, the eccentric portion is adapted to rotate clockwise about the second rotating axle, and the second stopping point limits a rotation angle of the stopper.

In an embodiment of the MFP of the present invention, the MFP further includes a paper feed roller disposed on the top cover. When the first side of the top cover rotates about the first rotating axle so as to be close to the paper holder, the paper feed roller contacts multiple pieces of paper placed in the paper holder, and the paper feed roller rotates to propel the paper to enter the paper conveyor path via the entrance of the paper conveyor path.

The present invention further provides a stopper adapted to be disposed in an MFP, and used to stop paper from entering a paper conveyor path of the MFP. The stopper has a rotating axle, a connecting portion and an eccentric portion. The rotating axle is adapted to be connected to a body of the MFP, the connecting portion is connected between the rotating axle and the eccentric portion, and a center of gravity of the stopper is located in the eccentric portion.

Based on the foresaid, the center of gravity of the stopper of the present invention is located in the eccentric portion. Since the center of gravity and the rotation center are located at two different positions when the stopper rotates about the rotating axle, the stopper is undoubtedly reposited by the aid of the weight of the stopper, so as to avoid the failure problem of the stopper. Therefore, the MFP using the stopper can effectively continuously operate.

In order to make the features and advantages of the present invention comprehensible, embodiments are described in detail below with reference to accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
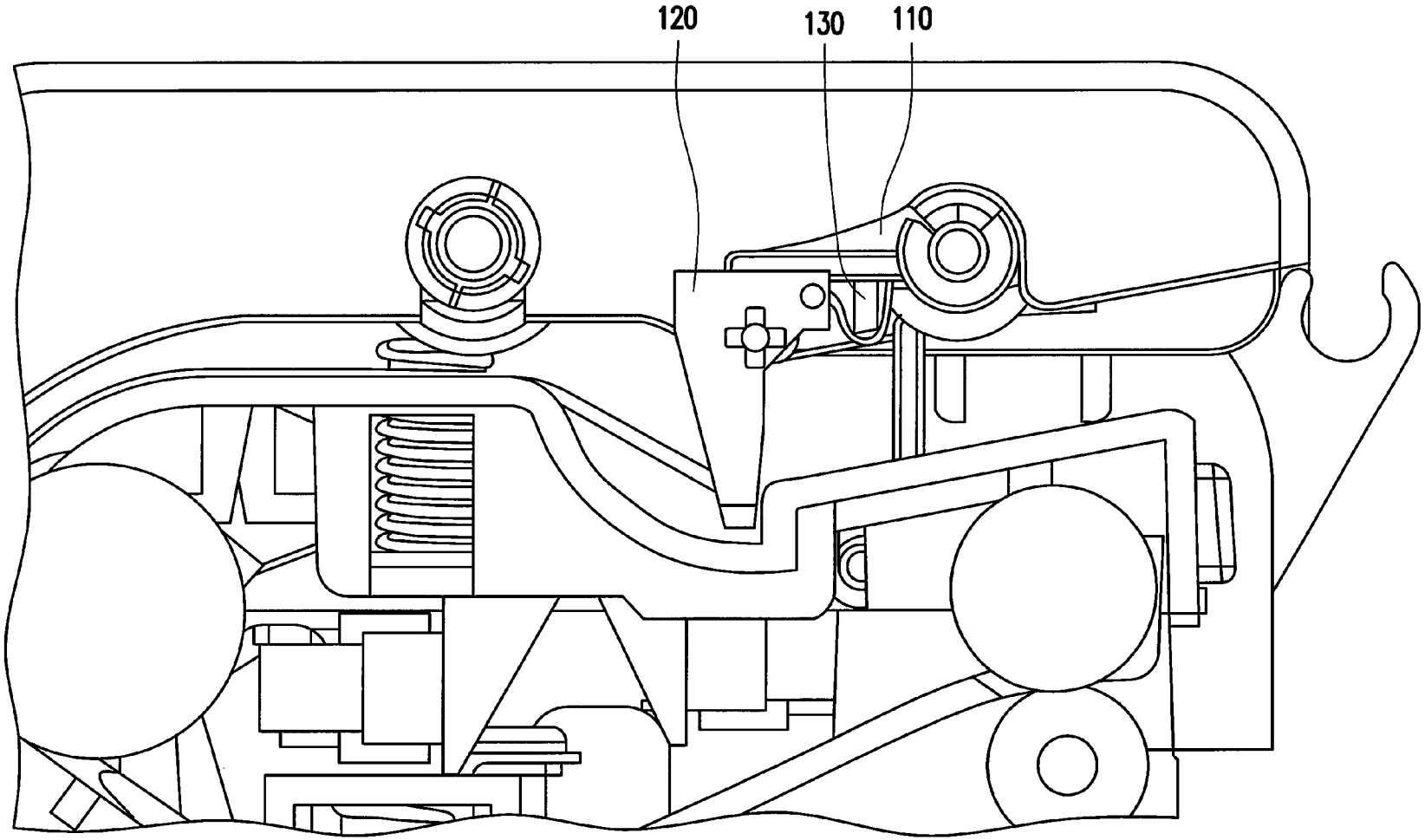
FIG. 1 (RELATED ART)
FIG. 1 is a schematic view of a conventional printer.

Reference will now be made in detail to the present embodiments of the invention, examples of which are illustrated in the accompanying drawings. Wherever possible, the same reference numbers are used in the drawings and the description to refer to the same or like parts.

Figure 2:
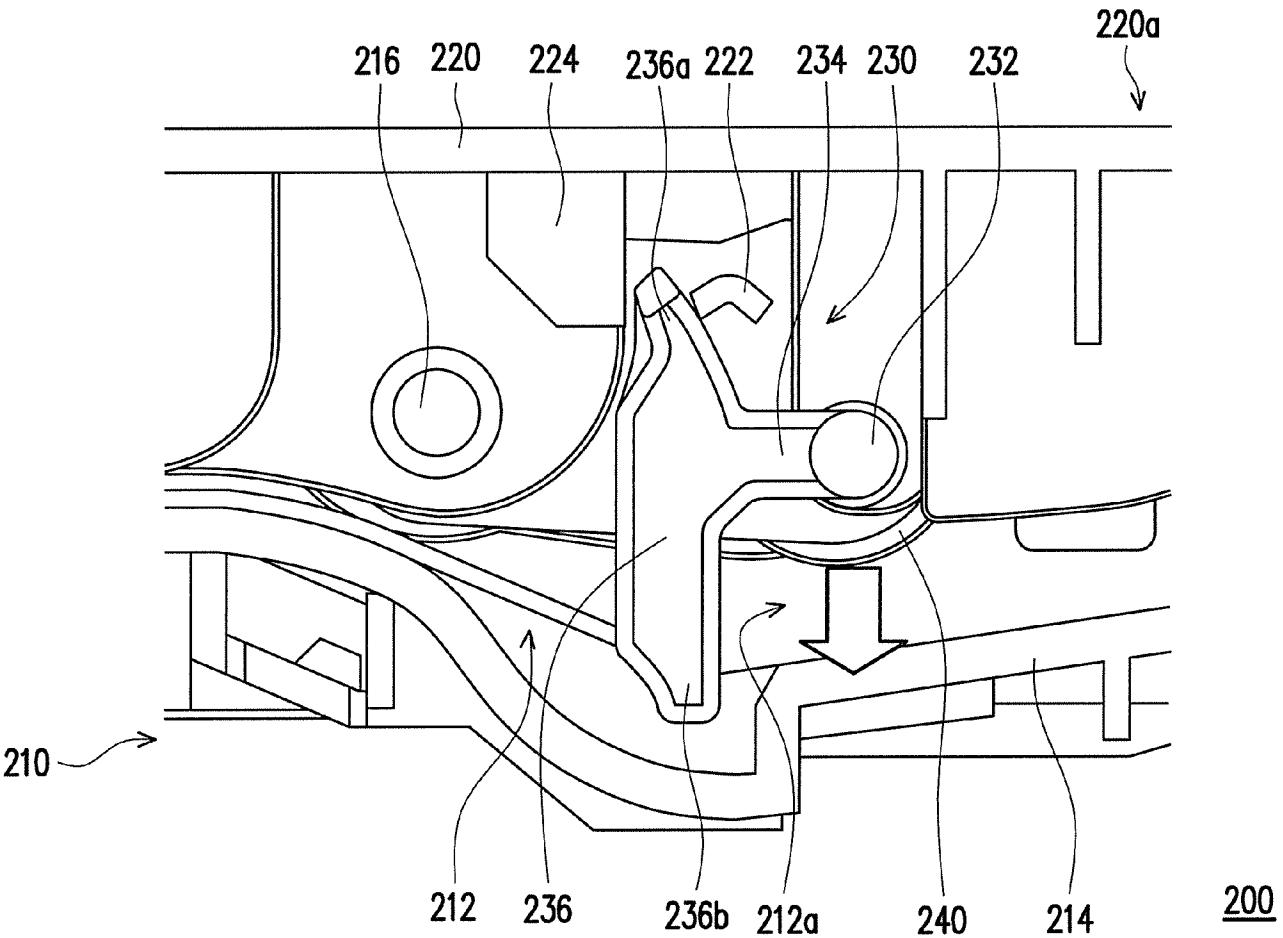
FIG. 2 is a schematic view of an MFP according to an embodiment of the present invention.

FIG. 2 is a schematic view of an MFP according to an embodiment of the present invention. Referring to FIG. 2, an MFP 200 includes a body 210, a top cover 220 and a stopper 230. The body 210 has a paper conveyor path 212, a paper holder 214, and a first rotating axle 216, in which the paper holder 214 is located in front of an entrance 212*a* of the paper conveyor path 212, and the first rotating axle 216 is located in the paper conveyor path 212. The top cover 220 is disposed on the body 210, and a first side 220*a* of the top cover 220 is adapted to rotate about the first rotating axle 216 so as to be close to the paper holder 214 of the body 210, in which the top cover 220 has a first stopping point 222. The stopper 230 has a second rotating axle 232, a connecting portion 234 and an eccentric portion 236. The second rotating axle 232 is connected to the body 210, the connecting portion 234 is connected between the second rotating axle 232 and the eccentric portion 236. A center of gravity of the stopper 230 is located in the eccentric portion 236, and the first stopping point 222 is located in a rotating path of the eccentric portion 236, so as to limit the rotation of the eccentric portion 236. Since the center of gravity of the stopper 230 is located in the eccentric portion 236, after the stopper 230 rotates clockwise about the second rotating axle 232, the eccentric portion 236 rotates counterclockwise about the second rotating axle 232 so as to be reposited, when an external force enabling the stopper 230 to rotate clockwise is released.

In addition, the top cover 220 further includes a second stopping point 224, and a first end 236*a* of the eccentric portion 236 that is kept relatively away from the entrance 212*a* is located between the first stopping point 222 and the second stopping point 224. Furthermore, the MFP 200 further includes a paper feed roller 240 disposed at the first side 220*a* of the top cover 220, and the paper feed roller 240 moves with the rotation of the first side 220*a*.

Referring to FIG. 2, specifically, when paper is not fed into the MFP 200, the eccentric portion 236 of the stopper 230 does not rotate about the second rotating axle 232 due to the limitation by the first stopping point 222 and the paper holder 214. The first stopping point 222 limits the first end 236*a* of the eccentric portion 236 that is relatively close to the first stopping point 222, and the paper holder 214 limits a second end 236*b* of the eccentric portion 236 that is relatively close to the paper holder 214. The second end 236*b* of the eccentric portion 236 that is relatively close to the paper holder 214 may naturally hang down at the entrance 212*a* of the paper conveyor path 212, and prop against the paper holder 214.

Figure 3:
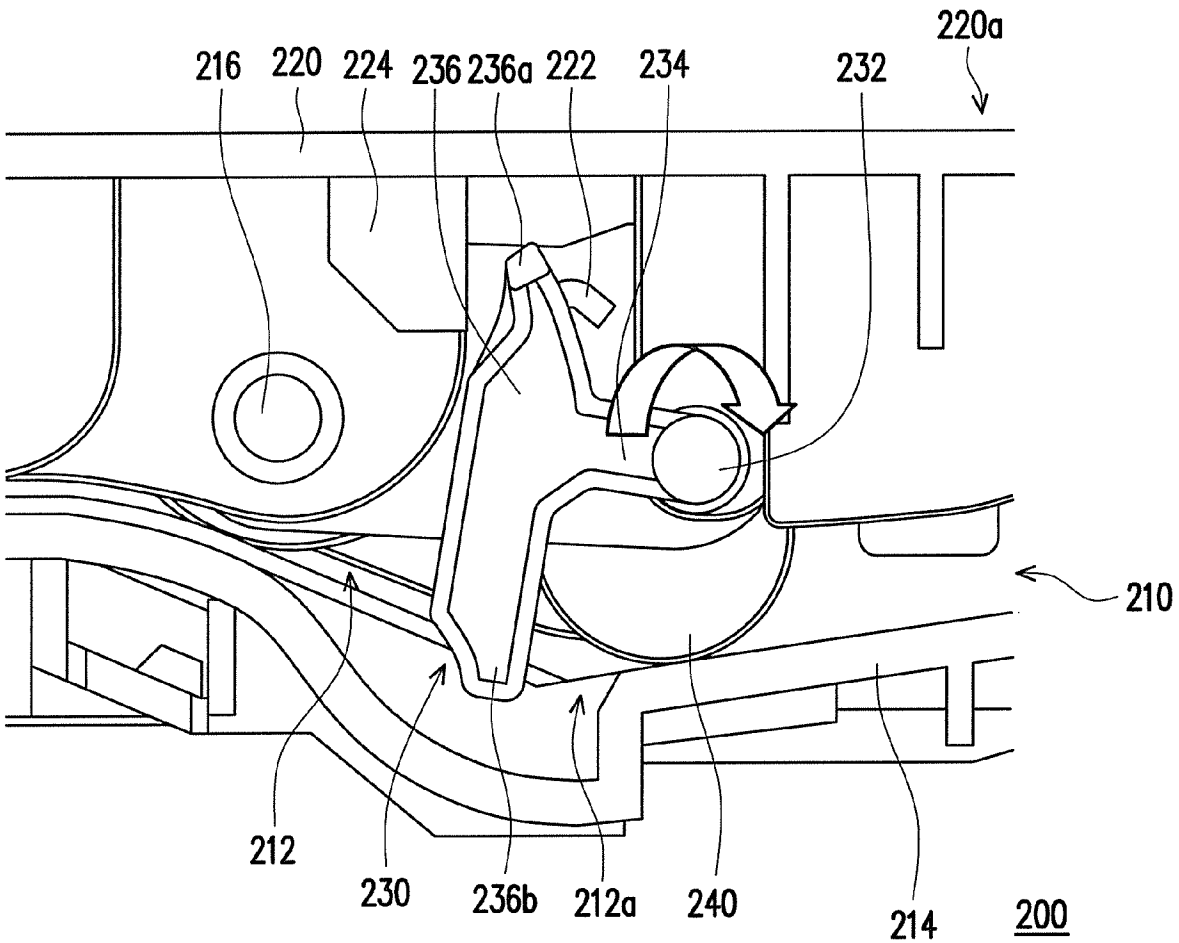
FIG. 3 to FIG. 5 are schematic flow charts of operations of a stopper when paper is fed into an MFP.
Figure 4:
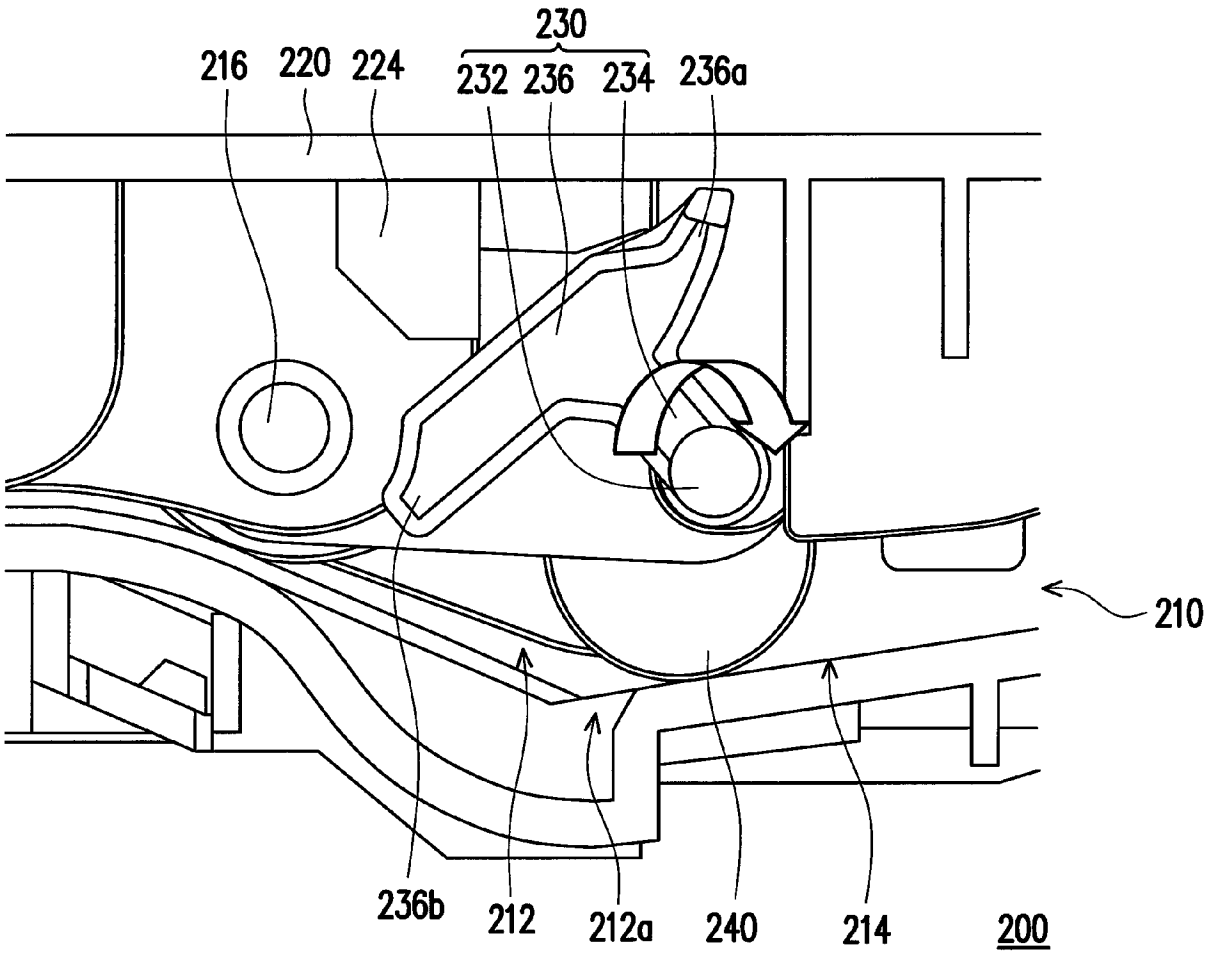
Figure 5:
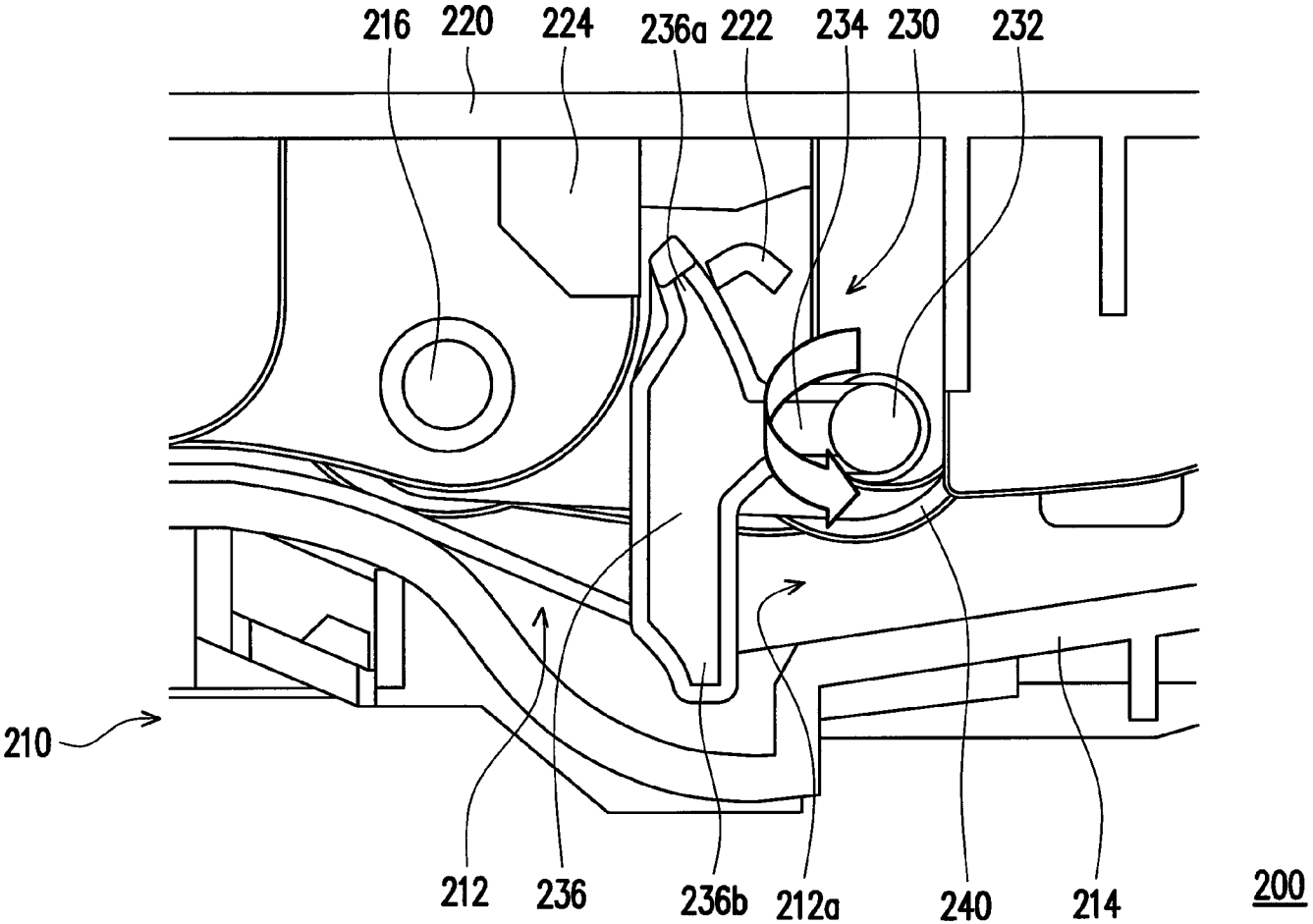

FIG. 3 to FIG. 5 are schematic flow charts of operations of a stopper when paper is fed into an MFP. Referring to FIG. 2 and FIG. 3, when the first side 220*a* of the top cover 220 rotates about the first rotating axle 216 so as to be close to the paper holder 214, the paper feed roller 240 disposed at the first side 220*a* further contacts multiple pieces of paper placed in the paper holder 214, as driven by the top cover 220, and begins to rotate, so as to propel the paper to enter the paper conveyor path 212 via the entrance 212*a* of the paper conveyor path 212.

In this case, the first stopping point 222 moves with the rotation of the top cover 220, and releases the limitation to the eccentric portion 236. By the force of the paper feed roller 240 that propels the paper to enter the paper conveyor path 212 via the entrance 212*a* of the paper conveyor path 212, the paper pushes the end (not shown) of the eccentric portion 236 that is relatively close to the paper holder 214, and in this case, the eccentric portion 236 rotates clockwise about the second rotating axle 232.

Referring to FIG. 3 and FIG. 4, when the eccentric portion 236 rotates clockwise about the second rotating axle 232, the second stopping point 224 is used to limit a rotation angle of the stopper 230, so as to avoid a too large rotation angle of the stopper 230. Specifically, when the rotation angle of the stopper 230 is too large, the first end 236*a* of the eccentric portion 236 rotates from a left side of the second rotating axle 232 to a right side of the second rotating axle 232, and after the second end 236*b* of the eccentric portion 236 rotates from the left side of the second rotating axle 232 to the right side of the second rotating axle 232, the eccentric portion 236 naturally falls since the center of gravity of the stopper 230 is located in the eccentric portion 236. In other words, the eccentric portion 236 is located at the right side of the second rotating axle 232 and thus located on the paper. As such, the stopper 230 cannot stop the paper from entering the paper conveyor path 212 via the entrance 212*a* of the paper conveyor path 212, and the stopper 230 fails, causing that the MFP 200 cannot effectively continuously operate.

Afterwards, referring to FIG. 4 and FIG. 5, when the paper feed roller stops rotating and does not perform the paper feeding procedure, and no paper applies a force on the second end 236*b* of the eccentric portion 236 of the stopper 230, since the center of gravity of the stopper 230 is located in the eccentric portion 236, the eccentric portion 236 naturally rotates counterclockwise about the second rotating axle 232 and is reposited to hang down at the entrance 212*a* of the paper conveyor path 212, so as to stop the entering of the paper.

Afterwards, the top cover 220 rotates about the first rotating axle 216, and the first side 220*a* of the top cover 220 is reposited. It should be noted that, the eccentric portion 236 is still located at the left side of the second rotating axle 232, which still can provide a desirable stopping effect.

It should be noted that, the directional terms mentioned in this embodiment, like "above", "below", "left", and "right", refer to the relative directions in the drawings, and is not intended to limit the present invention.

To sum up, the present invention provides a stopper with a structure different from that of a conventional stopper. Compared with the conventional MFP in which two or more stoppers need to be used to stop the paper, the paper stopping effect can be achieved with only one stopper when the stopper of the present invention is applied in the MFP, thereby effectively reducing the cost of the components.

In addition, the disposition of the stopping point can effectively limit the rotation and the rotation angle of the stopper.

Moreover, since the center of gravity of the stopper is located in the eccentric portion and has a distance from the second rotating axle, the stopper can be undoubtedly reposited by the aid of the weight of the stopper, and does not have the failure problem, so that the MFP can effectively continuously operate.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A multi-function printer (MFP), comprising:

a body, having a paper conveyor path, a paper holder and a first rotating axle, wherein the paper holder is located in front of an entrance of the paper conveyor path, and the first rotating axle is located in the paper conveyor path;

a top cover, disposed on the body, wherein a first side of the top cover is adapted to rotate about the first rotating axle so as to be close to the paper holder of the body, and the top cover has a first stopping point;

a paper feed roller, disposed on the top cover; and a stopper, having a second rotating axle, a connecting portion and an eccentric portion, wherein the second rotating axle is connected to the body, the connecting portion is connected between the second rotating axle and the eccentric portion, the eccentric portion has a first end and a second end with the weight of the second end is greater than the weight of the first end wherein the first end is above the second end, the eccentric portion hangs down at the entrance of the paper conveyor path, a center of gravity of the stopper is located in the second end of the eccentric portion, and the first stopping point is located in a rotating path of the eccentric portion, so as to limit the rotation of the eccentric portion;

wherein when the first side of the top cover rotates about the first rotating axle so as to be close to the paper holder, the first stopping point moves along with the top cover and releases the limitation to the eccentric portion, the paper feed roller contacts multiple pieces of paper placed in the paper holder and rotates to propel the paper to enter the paper conveyor path via the entrance of the paper conveyor path, and the paper pushes the second end of the eccentric portion that is relatively close to the paper holder, and the eccentric portion is adapted to rotate clockwise about the second rotating axle.

2. The MFP according to claim 1, wherein the top cover further comprises a second stopping point, and the first end of the eccentric portion that is kept relatively away from the entrance is interposed between the first stopping point and the second stopping point.

3. The MFP according to claim 2, wherein when the first side of the top cover rotates about the first rotating axle so as to be close to the paper holder, the eccentric portion is adapted to rotate clockwise about the second rotating axle, and the second stopping point limits a rotation angle of the stopper.

* * * * *